US006100967A

United States Patent [19]

Farrer et al.

[11] Patent Number: 6,100,967

[45] Date of Patent: Aug. 8, 2000

[54] MONITORING OF COVERT MARKS

[75] Inventors: Richard Mark Farrer; Barry Alan Hood, both of Gorseinon, United Kingdom

[73] Assignee: SLS Biophile Limited, United Kingdom

[21] Appl. No.: 08/849,737

[22] PCT Filed: Aug. 5, 1996

[86] PCT No.: PCT/GB96/01898

§ 371 Date: Jul. 2, 1997

§ 102(e) Date: Jul. 2, 1997

[87] PCT Pub. No.: WO97/06016

PCT Pub. Date: Feb. 20, 1997

[30] Foreign Application Priority Data

Aug. 3, 1995 [GB] United Kingdom ..... 9515948
Aug. 24, 1995 [GB] United Kingdom ..... 9517401

[51] Int. Cl.[7] ..... B42D 15/00

[52] U.S. Cl. ..... 356/71; 356/364

[58] Field of Search ..... 356/71, 364, 366; 283/90, 901

[56] References Cited

U.S. PATENT DOCUMENTS 3,657,085 4/1972 Hoffmeister et al. ..... 204/157.1 R
4,519,064 5/1985 Takagi et al. .
4,544,836 10/1985 Galvin et al. .
5,284,364 2/1994 Jain ..... 283/90
5,543,608 8/1996 Rantalainer ..... 283/90

FOREIGN PATENT DOCUMENTS 0 139 186 5/1985 European Pat. Off. .
0 188 625 7/1986 European Pat. Off. .
2 674 979 10/1992 France .
3-105489 5/1991 Japan .
2 111 910 7/1983 United Kingdom .
2 281 129 2/1995 United Kingdom .

*Primary Examiner*—Richard A. Rosenberger
*Attorney, Agent, or Firm*—David P. Gordon; David S. Jacobson; Thomas A. Gallagher

[57] ABSTRACT

A method and apparatus for monitoring a body having a reflective surface (1), a coating layer (2) of material transparent to visible light present on the surface (1) and producing a covert optical discontinuity in an imagewise distribution on the layer (2); the imagewise distribution is such that it is visible via polarized light (7) and viewing through a polarized filter (8).

17 Claims, 1 Drawing Sheet

MONITORING OF COVERT MARKS

BACKGROUND OF THE INVENTION

The present invention relates to a method of optically monitoring a body having a reflective surface and a covert optical discontinuity produced on the surface.

It is often desirable to apply a covert mark to an object, for example, in order to identify goods or the like, which can be useful in anti-counterfeiting measures or which can allow for the application of a code specific to a container, thus facilitating product tracking.

Many types of covert marking systems have been proposed. It is known for example to mark objects using laser radiation. U.S. Pat. No. 4,758,703 describes a method of covertly encoding a microscopically visible pattern on a surface of an object in which a beam of unfocussed laser radiation is passed through a mesh to produce the desired pattern, the intensity of the laser beam being carefully controlled so that the pattern is barely etched onto the surface and remains visible to the eye. U.S. Pat. No. 4,769,310 describes a method of marking ceramic materials, glazes, glass ceramics and glasses that contain at least one radiation-sensitive additive in which a laser beam is focussed on to the surface of the material to be marked so as to induce a colour change within the irradiated area.

GB2247677 discloses a method and apparatus for providing a body of material with a sub-surface mark in the form of an area of increased opacity to electromagnetic radiation. The method comprises directing a high energy density beam to which the material is transparent and bringing the beam to focus at a location spaced from the surface and within the body so as to cause localized ionisation of the material. The apparatus includes a laser and provides means to move the focus of the beam relative to the body so as to enable the mark to be of a predetermined shape.

Such covert marking systems are generally only effective for glass or ceramic based products.

OBJECT OF THE INVENTION

Therefore, it is the purpose of the present invention to alleviate such difficulties and to provide a method and apparatus for optically monitoring a body having a reflective surface, and an optical discontinuity produced thereon.

SUMMARY OF THE INVENTION

Thus, according to a first aspect of the invention there is provided a method of optically monitoring a body having a reflective surface and a coating layer of material transparent to visible light present on the surface, which method comprises: producing the layer with a covert optical discontinuity in an imagewise distribution; illuminating the imagewise distribution with polarized light; and viewing the imagewise distribution through a polarized filter.

DESCRIPTION OF THE PREFERRED EMBODIMENTS

In a first embodiment of the present invention, the optical discontinuity is produced by directing a high energy laser beam at a predetermined area of the layer such that the irradiated area is detectable by the viewing. The high energy laser beam is typically such that it causes photoablation of the transparent material, but no substantial change to the reflective surface. Power densities suitable for causing photoablation are known in the art (typically $10^3$ W/cm$^3$ to $10^{11}$ W/cm$^3$).

In one preferred mode of operation of the first embodiment of the invention, the beam has a focus which is movable relative to the transparent material. In an alternative mode of operation the beam may be pulsed through a mask such that the entire optical discontinuity is formed simultaneously.

In a second embodiment of the present invention the optical discontinuity is produced by printing the transparent material in the imagewise distribution on the surface such that the coating layer is itself discontinuous.

Thus, advantageously, a covert mark may be produced on a reflective surface, which surface itself can comprise the product to be identified or alternatively which can be on a product to be identified. The mark can be easily viewed through a filter upon illumination with polarized light.

The term "transparent" as used herein with reference to the coating and/or printing material means a material which permits light to pass therethrough; the coating and/or printing material preferably causes scattering and/or change of polarisation effect of at least some of a light beam passing therethrough.

The term "covert" as used herein with reference to the mark or optical discontinuity means a mark or optical discontinuity which is visible on illumination with polarized light and viewing through a polarized filter, but not visible using non-polarized light.

Preferably, the mark is of a predetermined shape, such as in the form of numerals, letters, or symbols or a combination thereof.

Preferably, the reflective surface comprises a shiny metal, or other reflective material which can advantageously be in the form of a label, tag or the like, and which may be used in or on a product to be identified. Further preferably the shiny metal is aluminum.

According to a second aspect of the present invention there is provided apparatus for optically monitoring a body having a reflective surface and a coating layer of material transparent to visible light on the surface, which apparatus comprises production means for producing a covert optical discontinuity in an imagewise distribution on the layer, means for illuminating the imagewise distribution with polarized light, and viewing means to view the imagewise distribution through a polarized filter.

In a first embodiment of the second aspect of the invention the production means comprises a high energy laser beam arranged to focus on the layer. Preferably the laser beam comprises a scanning, focussed $CO_2$ laser beam or a pulsed $CO_2$ laser beam passed through a mask. In either case, the power output is preferably at least 10 watts. The power density is typically at least 1 kwatt/cm$^2$, up to a power density which might damage the reflective surface.

Preferably, the apparatus further comprises means to move the focus of the beam relative to the transparent material, thus enabling the mark to be of a predetermined shape. Typically means to move the focus of the beam comprises either at least one movable mirror disposed in the path of the beam or a lens element of variable focal length in the form of a correcting lens arranged to focus the beam on the surface of the transparent material.

In a second embodiment of the second aspect of the invention the production means comprises a printer for printing the transparent material in the imagewise distribution on the surface.

According to a third aspect of the present invention there is provided a member having a reflective surface and a coating layer of material transparent to visible light present on the surface, the coating producing a covert optical discontinuity in an imagewise distribution, the imagewise distribution being visible by illumination and viewing through a polarized filter.

The optical discontinuity may comprise one or more numerals, letters or symbols or a combination thereof, while advantageously the covertly marked member may comprise any suitable object, such as a banknote, a pharmaceutical pack or the like.

BRIEF DESCRIPTION OF THE DRAWINGS

The invention may be more clearly understood with reference to the accompanying drawings, given by way of example only, wherein.

DETAILED DESCRIPTION OF THE PREFERRED EMBODIMENTS

Figure 1:
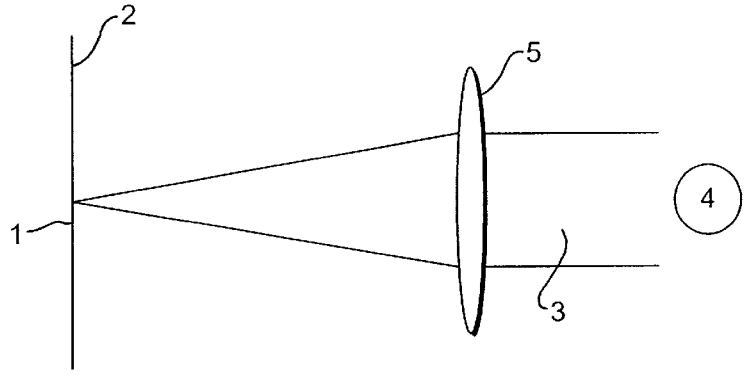
FIG. 1 illustrates the application of the focussed laser beam to a body having a reflective surface.
Figure 2:
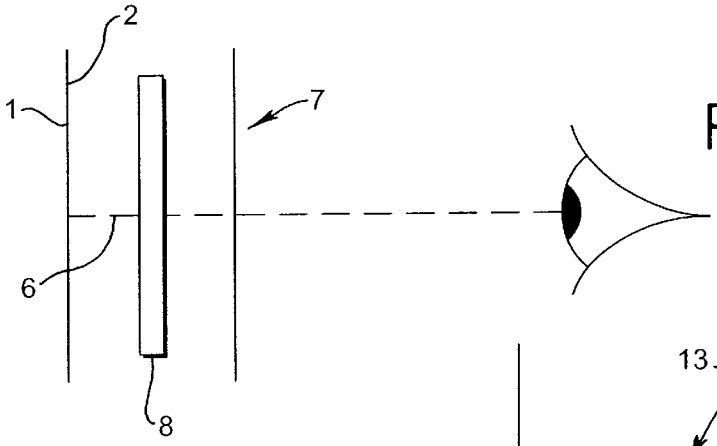
FIG. 2 illustrates the use of the light source and filter to view the mark.

Referring to FIGS. 1 and 2, there is illustrated a method and apparatus for covertly marking a reflective aluminum tag 1 coated with a transparent light scattering material 2. A high energy laser beam 3 from a laser source 4 is brought into focus on the transparent coating 2 by a focussing lens 5. The laser beam 3 is moved relative to the coating 2, to create a mark 6 on the transparent coating 2. In order to view the mark 6 a polarized light source 7 is used to illuminate the transparent coating 2, and a circularly polarized light filter 8 is placed over the transparent coating 2. The filter 8 eliminates the reflected polarized light emanating from the mark 6 as the light is reflected back from the reflective surface 1, but allows passage therethrough of the light which is scattered by the coating 2. The mark 6 appears black against the silver background of the coated aluminum tag 1.

Figure 3:
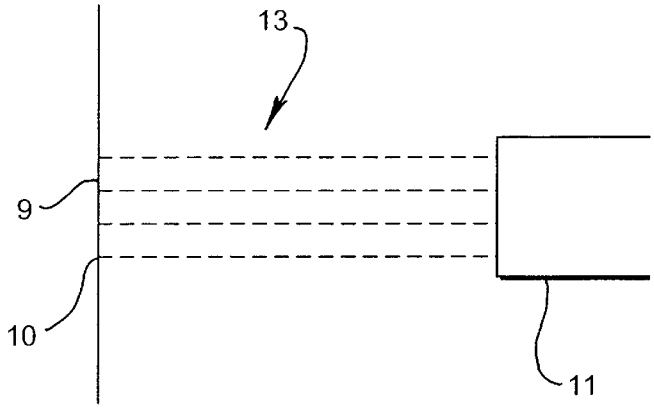
FIG. 3 illustrates the application of the transparent mark to a body having a reflective surface.
Figure 4:
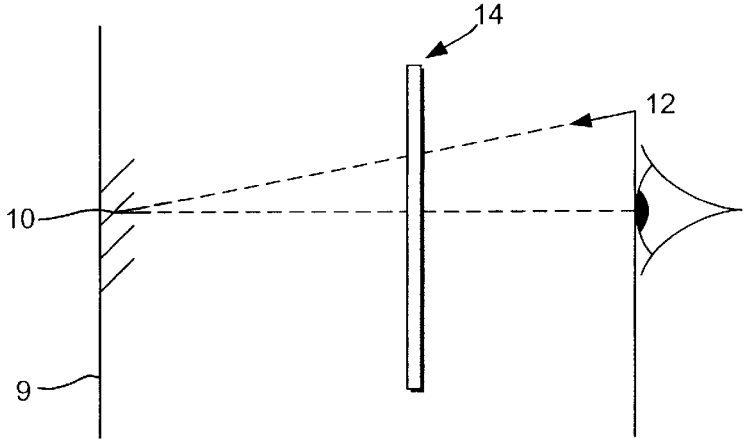
FIG. 4 illustrates the use of the light source and filter to view the mark.

Referring to FIGS. 3 and 4, there is illustrated a method for covertly marking a reflective aluminum tag 9 with a mark 10 of a transparent light scattering material. To create a light scattering mark on the reflective material, a printer head 11 applies the transparent material 13 to the tag 9. In order to view the mark 10 (FIG. 2) a polarized light source 12 is used to illuminate the mark 10, and a circularly polarized light filter 14 is placed over the transparent mark 10. The filter 14 eliminates the reflected polarized light emanating from the mark 10 as the light is reflected back from the reflective surface 9, but allows passage therethrough of the light which is scattered by the mark 10. The mark 10 appears black against the silver background of the coated aluminum tag 9.

What is claimed is:

1. A method of optically monitoring a body for identification purposes which comprises:

(a) providing a covert optical discontinuity comprising an imagewise distribution of light scattering material transparent to visible light on a reflective surface;

(b) illuminating said imagewise distribution with polarized light; and (c) viewing said imagewise distribution through a polarizing filter.

2. A method according to claim 1, wherein said optical discontinuity is produced by a high energy laser beam so as to cause photoablation of a predetermined area of said light scattering material.

3. A method according to claim 2, wherein said laser beam has a focus which is movable relative to an area of said light scattering material.

4. A method according to claim 1, wherein said optical discontinuity has a predetermined shape.

5. A method according to claim 1, wherein said reflective surface comprises a shiny metal.

6. A method according to claim 5, wherein said shiny metal is aluminum.

7. A method of optically monitoring a body having a reflective surface, which method comprises:

(a) printing a coating layer of light scattering transparent material in an imagewise distribution on said reflective surface such that said coating layer of transparent material is discontinuous and thereby forms a covert optical discontinuity in an imagewise distribution;

(b) illuminating said imagewise distribution with polarized light; and (c) viewing said imagewise distribution through a polarized filter.

8. A method according to claim 7, wherein said optical discontinuity has a predetermined shape.

9. A method according to claim 7, wherein said reflective surface comprises a shiny metal.

10. A method according to claim 9, wherein said shiny metal is aluminum.

11. An apparatus for optically monitoring a body having a reflective surface, which apparatus comprises:

(a) production means for producing a covert optical discontinuity comprising an imagewise distribution of light scattering material transparent to visible light on said surface;

(b) means for illuminating said imagewise distribution with polarized light; and (c) viewing means to view said imagewise distribution through a polarized filter.

12. Apparatus according to claim 11, wherein said production means comprises a laser source capable of producing a high energy laser beam to focus on said light scattering material.

13. Apparatus according to claim 12, wherein said laser beam produces a power density of at least one kilowatt per $cm^2$.

14. Apparatus according to claim 12, which further comprises means to move said focus of said beam reflective to said light scattering material.

15. Apparatus according to claim 12, wherein said means to move said focus of said beam comprises a lens element of variable focal length in the form of a correcting lens.

16. An apparatus for optically monitoring a body having a reflective surface, which apparatus comprises:

(a) production means comprising a printer for printing a coating layer of a light scattering transparent material in an imagewise distribution on said reflective surface such that said coating layer of transparent material is discontinuous and thereby forms a covert optical discontinuity in an imagewise distribution;

(b) means for illuminating said imagewise distribution with polarized light; and (c) viewing means to view said imagewise distribution through a polarizing filter.

17. A member having a reflective surface and a covert optical discontinuity comprising an imagewise distribution of light scattering material transparent to visible light present on said reflective surface, said imagewise distribution being visible by illumination with polarized light and viewing through a polarizing filter.

* * * * *